US007478711B2

(12) United States Patent
Liang

(10) Patent No.: US 7,478,711 B2
(45) Date of Patent: Jan. 20, 2009

(54) ERGONOMIC WHEELED BAGGAGE

(76) Inventor: Joseph Liang, No. 30, Hsing-Tien Rd., Lin 11, Hsin-Nan Tsun, Kao-Shu Hsiang, Ping-Tung Hsien (TW)

( * ) Notice: Subject to any disclaimer, the term of this patent is extended or adjusted under 35 U.S.C. 154(b) by 718 days.

(21) Appl. No.: 11/110,061

(22) Filed: Apr. 19, 2005

(65) Prior Publication Data

US 2006/0231364 A1 Oct. 19, 2006

(51) Int. Cl.
*A45C 5/14* (2006.01)

(52) U.S. Cl. ..... 190/18 A; 280/37

(58) Field of Classification Search ..... 190/18 A; 280/37, 47.315

See application file for complete search history.

(56) References Cited

U.S. PATENT DOCUMENTS 2,316,328 A * 4/1943 Guenther et al. ..... 190/124
5,630,521 A 5/1997 Waddell et al. ..... 190/18 A
5,758,752 A * 6/1998 King et al. ..... 190/18 A
5,873,145 A * 2/1999 Chou ..... 16/46
6,148,971 A * 11/2000 Kho ..... 190/18 A
6,279,796 B1 * 8/2001 Trevino ..... 224/153
6,644,448 B2 * 11/2003 Bernbaum et al. ..... 190/111
2004/0154889 A1 * 8/2004 Gifford et al. ..... 190/18 A

* cited by examiner

*Primary Examiner*—Tri M Mai
(74) *Attorney, Agent, or Firm*—Ladas & Parry LLP

(57) ABSTRACT

An ergonomic wheeled baggage case includes top and bottom sides, and front, rear, and left and right panels. A first distance between the front and rear panels is shorter than a second distance between the left and right panels. A set of front wheels and a set of rear wheels are attached respectively to front and rear ends of the bottom side, and have bottommost ends which are substantially coplanar on a plane. The bottom side is oblique to the plane so that the front end of the bottom side is higher than the rear end thereof, thereby shifting the center of gravity of the case body rearwardly. The front, rear, left and right panels are substantially perpendicular to the plane.

2 Claims, 6 Drawing Sheets

ERGONOMIC WHEELED BAGGAGE

BACKGROUND OF THE INVENTION

1. Field of the Invention

The invention relates to a baggage case, more particularly to an ergonomic wheeled baggage.

2. Description of the Related Art

Referring to FIGS. 1 and 2, a conventional ergonomic upright wheeled baggage 50, as disclosed in U.S. Pat. No. 5,630,521, is shown to include a main body 1, two front wheels 2 (only one is visible), two rear wheels 3 (only one is visible), and a retractable handle 4. The main body 1 has a front side 101, a rear side 102, a top side 103, a bottom side 104, and two lateral sides 105. Each of the front and rear sides 101, 102 is inclined at an angle θ with respect to a line 5 perpendicular to a substantially horizontal supporting surface 6, such as the ground. The top and bottom sides 103, 104 are substantially parallel to the supporting surface 6.

When the conventional wheeled baggage 50 is pushed or towed by a user on the ground, all four wheels are in contact with the ground, so that an additional force for tilting the conventional wheeled baggage 50 need not be exerted by the user. Further, since the conventional wheeled baggage 50 is configured as a parallelogram, its center of gravity is shifted rearwardly and away from the front wheels 2. When the conventional wheeled baggage 50 is pushed or towed by the user along an uneven surface, it will not tip over even if the front wheels 2 are chocked.

Although the aforementioned conventional wheeled baggage 50 can minimize the load borne by the user during pushing or towing of the baggage case 50, it has the following drawbacks during use:

1. Since the front and rear sides 101, 102 of the main body 1 are inclined rearwardly, the conventional wheeled baggage case 50 occupies a substantial space.

2. Since the front and rear sides 101, 102 of the main body 1 are inclined rearwardly, when the conventional wheeled baggage case 50 is in the still position, it is easily tipped rearwardly by an external force (F).

Another conventional wheeled baggage case 60 is shown in FIG. 3 to include a main body 7, four wheels 8 (only two are visible), two of which are disposed in front of the main body 7, and the other two of which are disposed at the back of the main body 7, and a handle 9. The main body 7 has a vertical front side 701, a rear side 702 parallel to the front side 701, a horizontal top side 703, a bottom side 704 parallel to the top side 703, and two lateral sides 705. When the conventional wheeled baggage case 60 is pushed, all four wheels 8 are in contact with the ground. However, since the conventional wheeled baggage case 60 has a rectangular configuration with the center of gravity located along a central line thereof, when the conventional wheeled baggage case 60 is pushed along an uneven surface, it is easily tipped over.

SUMMARY OF THE INVENTION

Therefore, the object of the present invention is to provide an ergonomic wheeled baggage case that occupies less space and that has good stability.

According to this invention, an ergonomic wheeled baggage case comprises a case body, a set of front wheels, a set of rear wheels, and a handle attached to the case body. The case body includes a top side, a bottom side, and front, rear, left and right panels interconnecting the top and bottom sides. The bottom side has front and rear ends connected respectively to the front and rear panels. The front and rear panels are spaced apart from each other at a first distance. The left and right panels are spaced apart from each other at a second distance which is longer than the first distance. The front and rear wheels are attached respectively to the front and rear ends of the bottom side, and have bottommost ends which are substantially coplanar on a plane. The bottom side is oblique to the plane. The front, rear, left and right panels are substantially perpendicular to the plane. The top side is substantially parallel to the plane. The front end of the bottom side has a height from the plane higher than that of the rear end of the bottom side.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
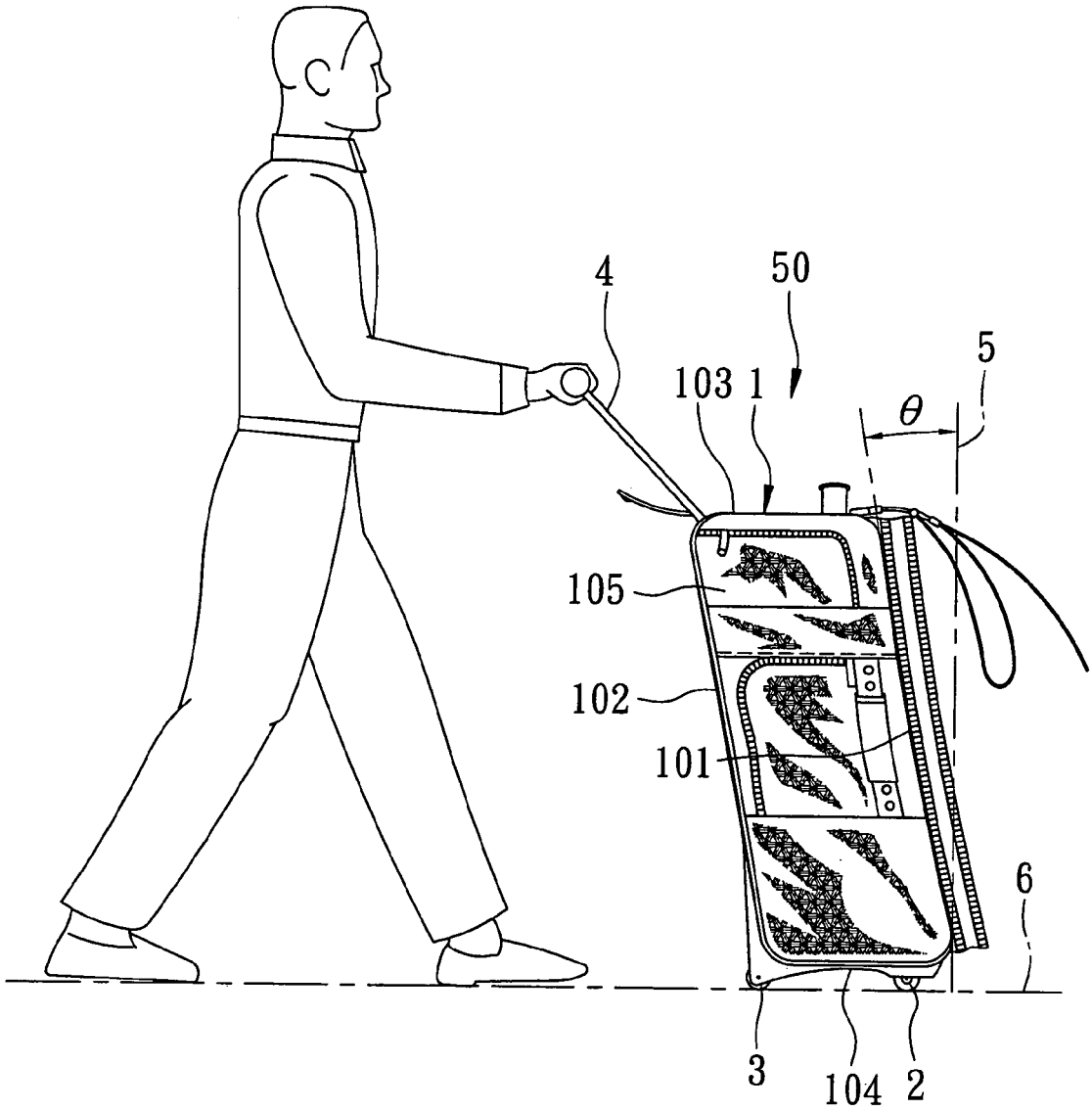
FIG. 1 PRIOR ART
FIG. 1 illustrates a conventional ergonomic upright wheeled baggage case according to U.S. Pat. No. 5,630,521.
Figure 2:
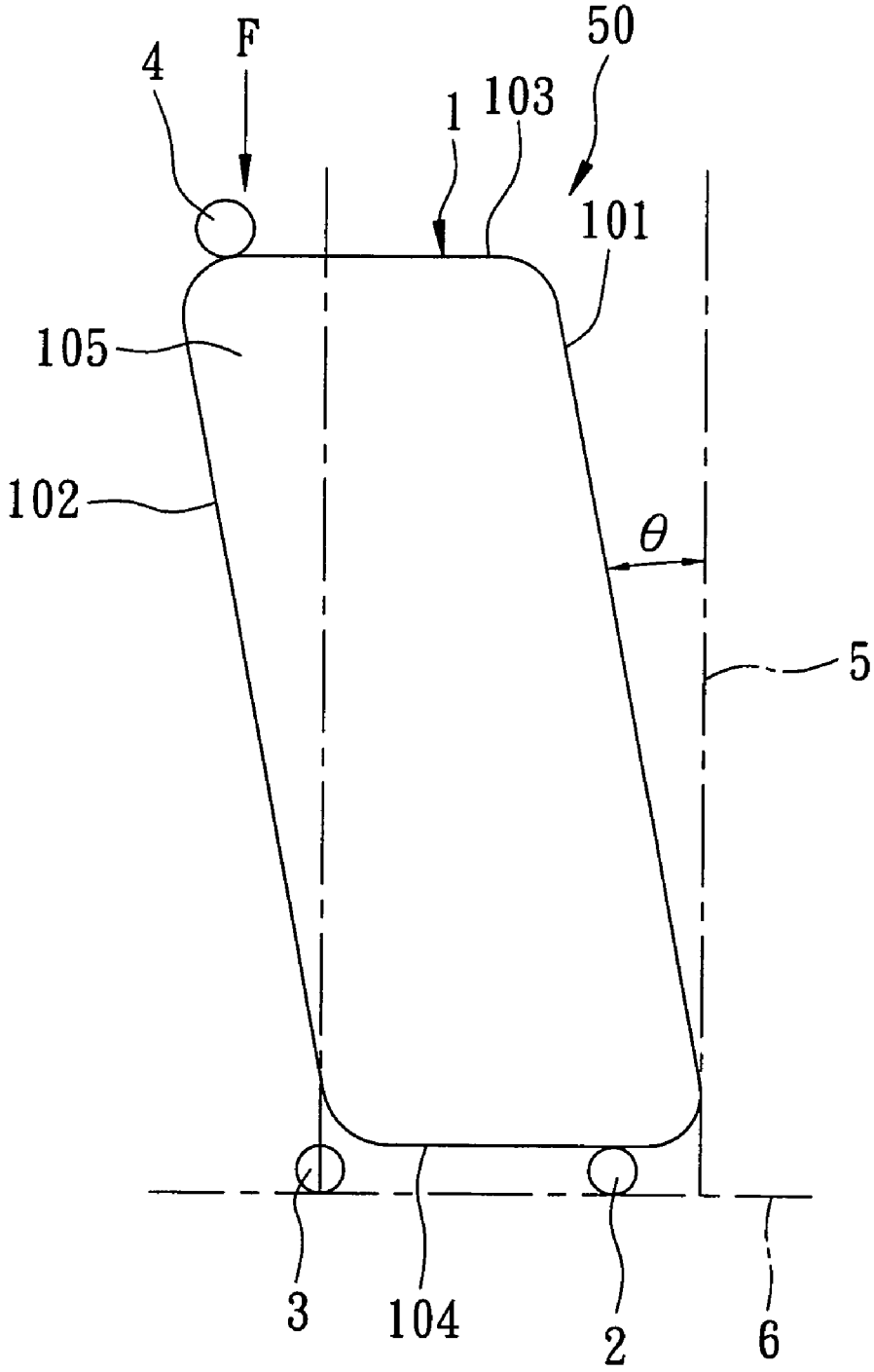
FIG. 2 PRIOR ART
FIG. 2 is a schematic side view of the baggage case of FIG. 1.
Figure 3:
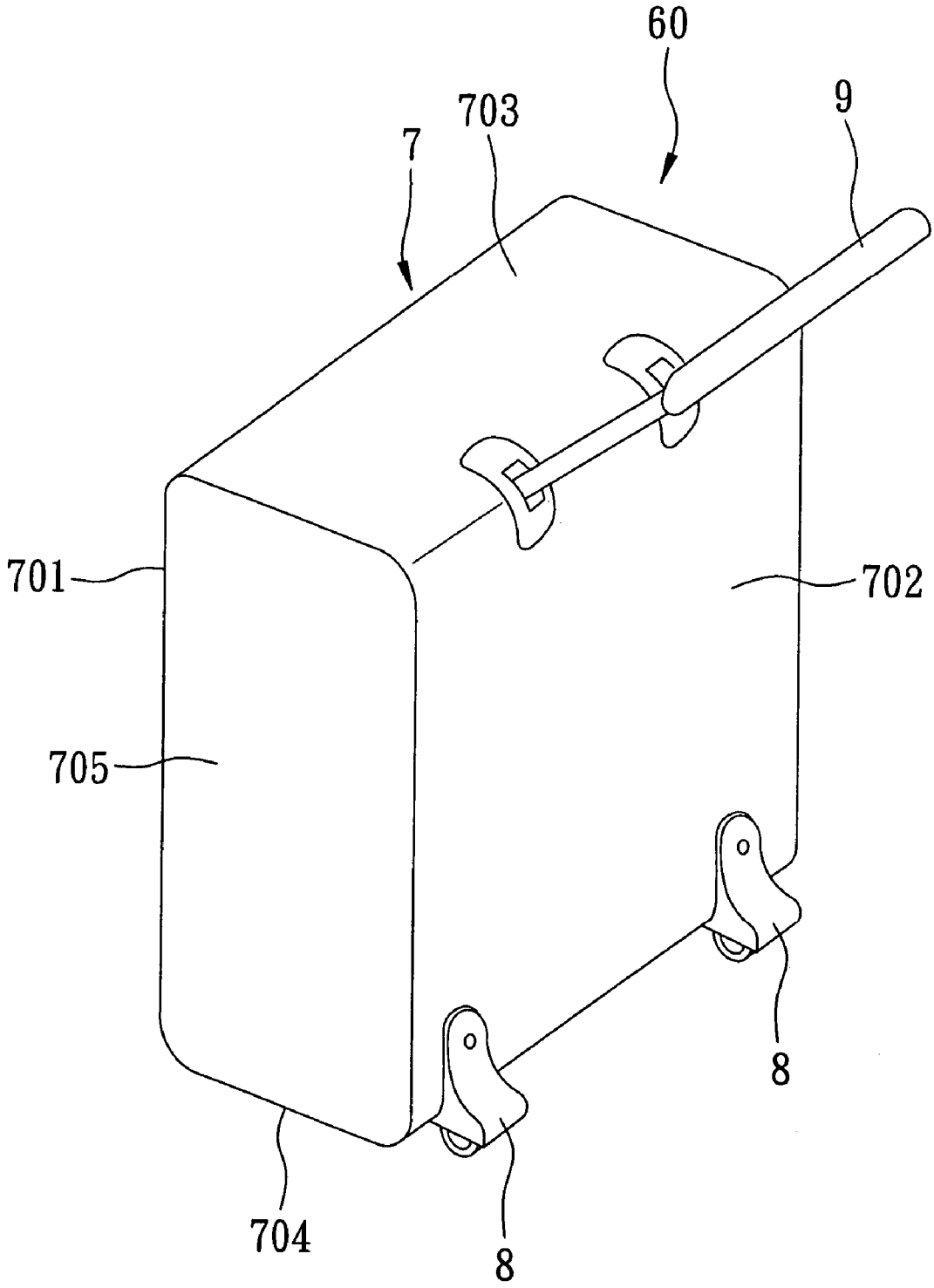
FIG. 3 PRIOR ART
FIG. 3 is a perspective view of another conventional wheeled baggage case.
Figure 4:
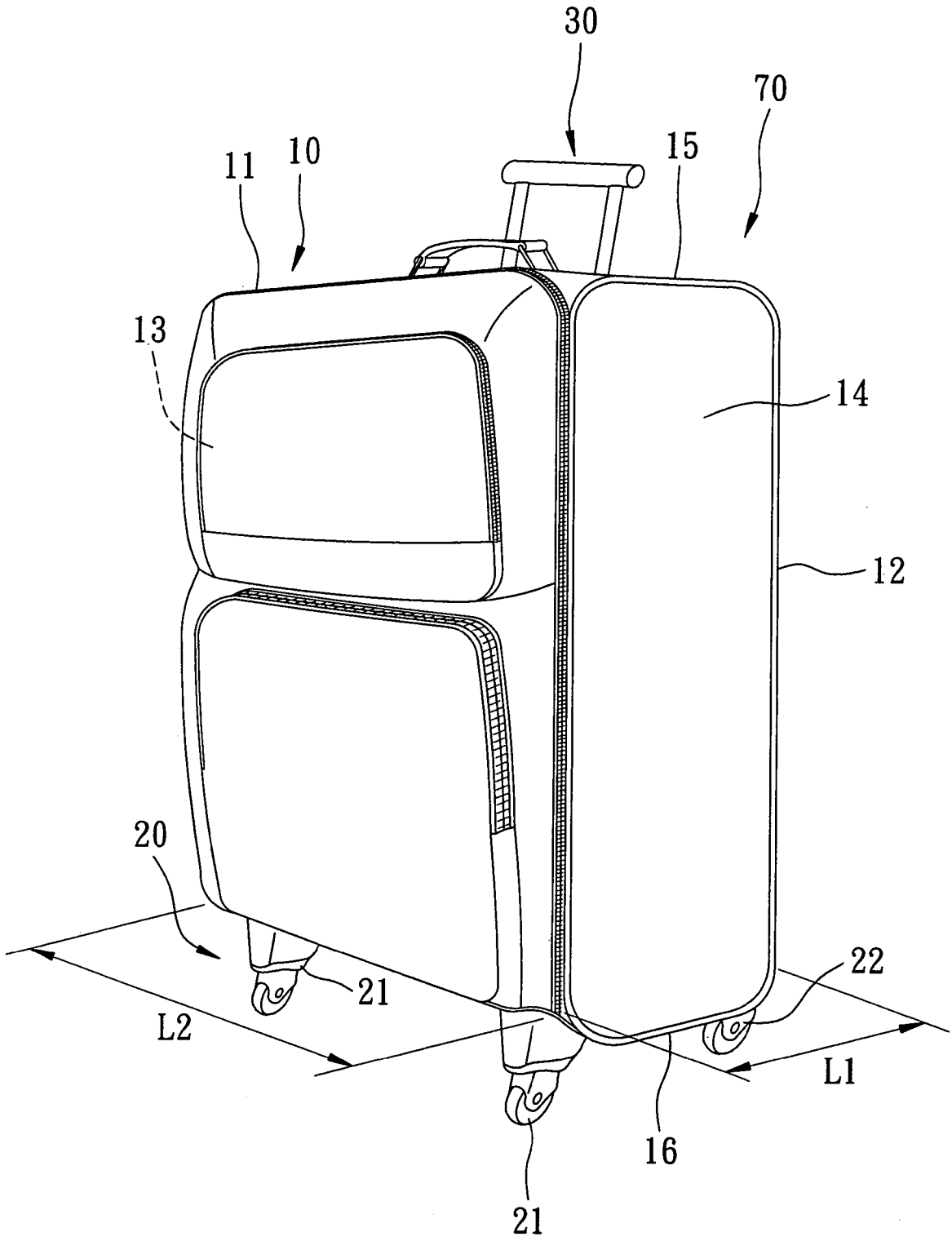
FIG. 4 is a perspective view of the preferred embodiment of an ergonomic wheeled baggage case according to the present invention.
Figure 5:
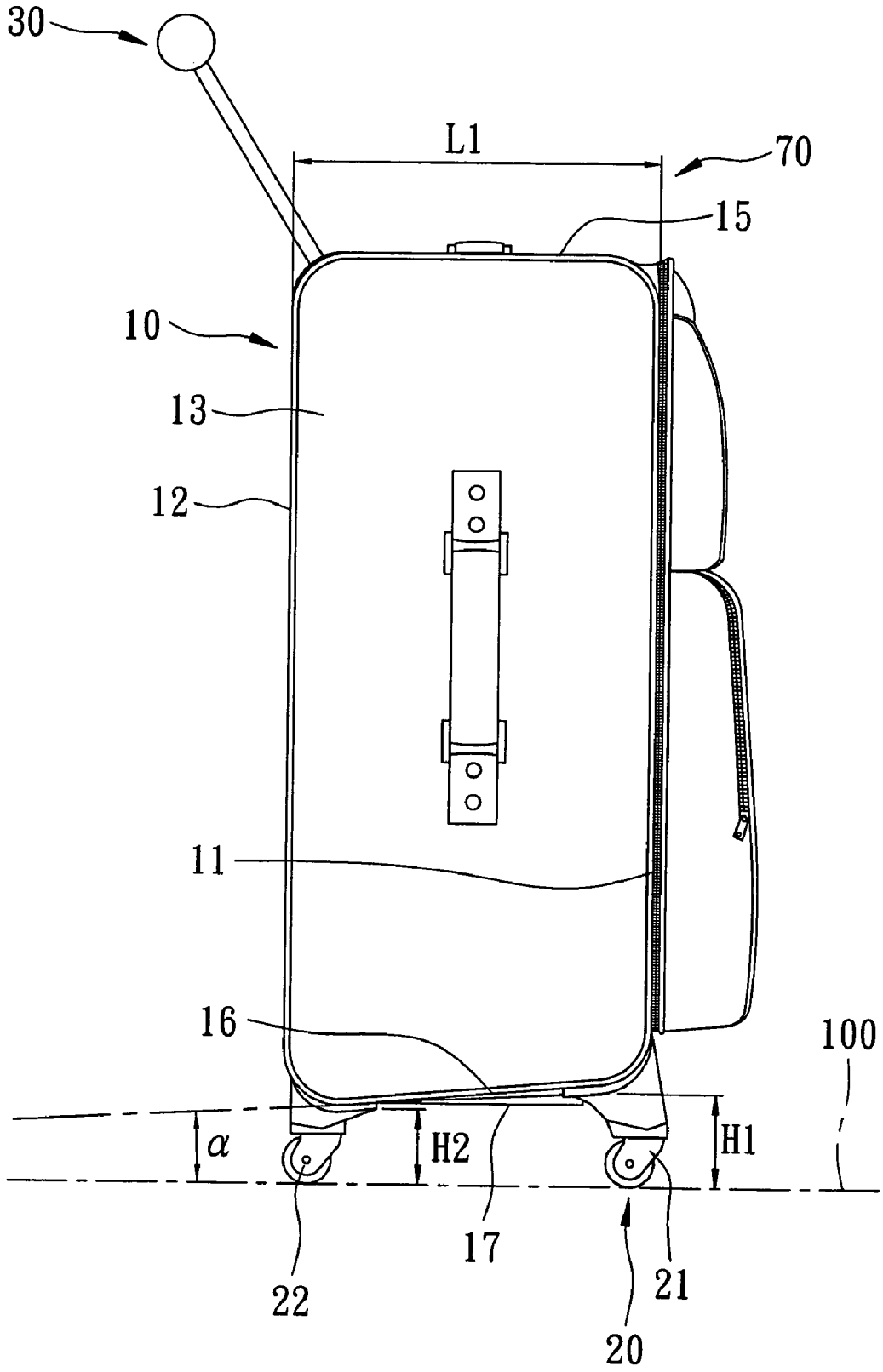
FIG. 5 is a schematic side view of the preferred embodiment.
Figure 6:
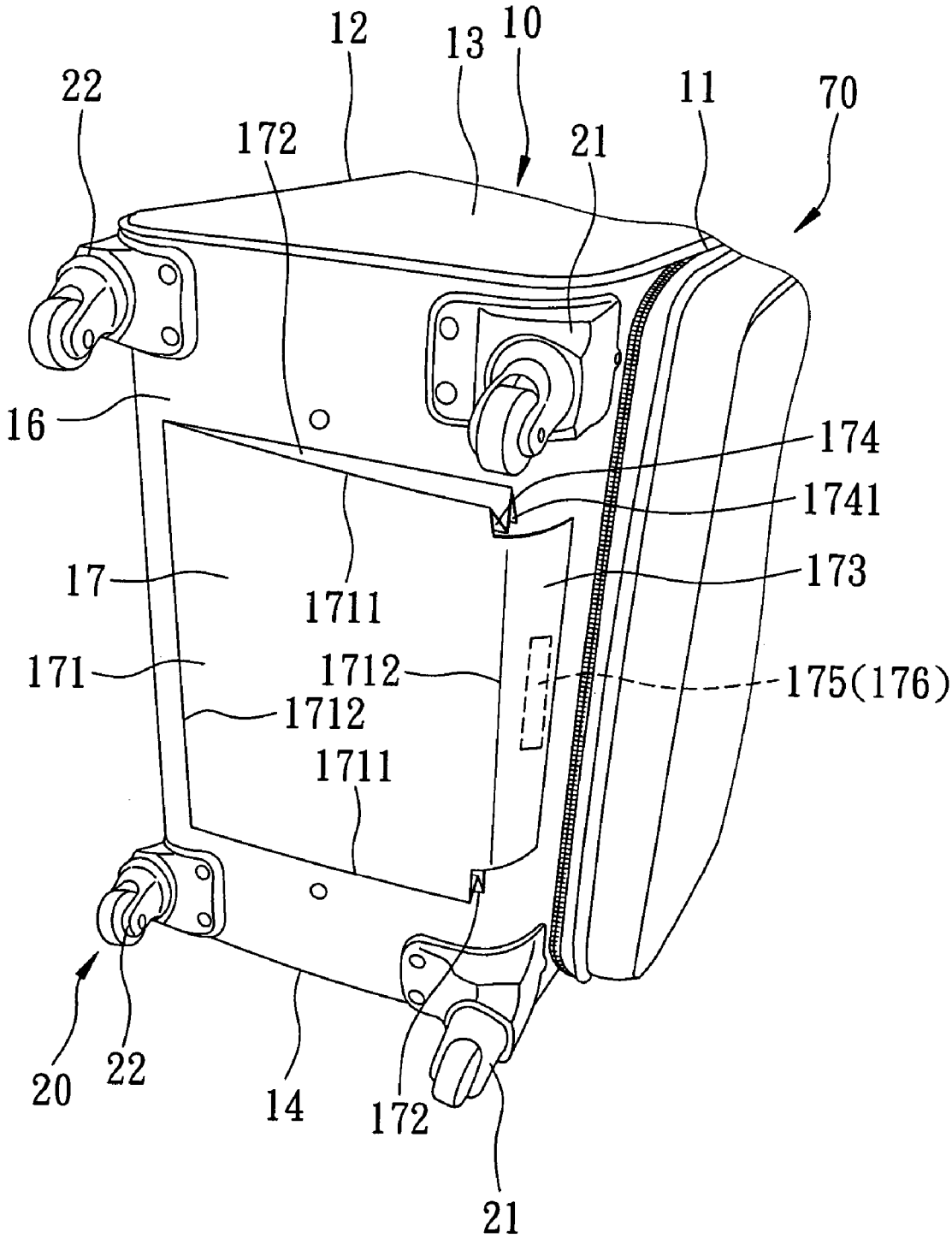
FIG. 6 is a perspective view, illustrating a receptacle provided on a bottom side of the wheeled baggage case of the present invention.

Referring to FIGS. 4 to 6, the preferred embodiment of an ergonomic wheeled baggage case 70 according to the present invention is adapted to be moved along a supporting surface, such as the ground, and is shown to comprise a case body 10 and a handle 30.

The case body 10 has a top side 15, a bottom side 16, a receptacle, and front, rear, left and right panels 11, 12, 13, 14 interconnecting the top and bottom sides 15, 16. The bottom side 16 has front and rear ends connected respectively to the front and rear panels 11, 12. The front and rear panels 11, 12 are spaced apart from each other at a first distance (L1). The left and right panels 13, 14 are spaced apart from each other at a second distance (L2) which is longer than the first distance (L1).

The receptacle is attached to the bottom side 16 of the case body 10. In this embodiment, the receptacle is configured as a pouch 17 for receiving a light item, such as a newspaper (not shown). The pouch 17 includes a rigid bottom wall 171, two pleated walls 172, a cover part 173, a first fastening member 175, and a second fastening member 176. The rigid bottom wall 171 is opposite to the bottom side 16, and has a pair of first sides 1711 and a pair of second sides 1712. Each of the pleated walls 172 is connected between a respective one of the first sides 1711 of the bottom wall 171 and the bottom side 16. One of the second sides 1712 of the bottom wall 171 is connected directly to the bottom side 16 of the case body 10. The bottom wall 171, the pleated walls 172, and the bottom side 16 cooperatively define a receiving space 174, and an opening 1741 in the vicinity of the other one of the second sides 1712 of the bottom wall 171. The cover part 173 has one end connected to said other one of the second sides 1712 of the bottom wall 171, and another end that extends from the bottom wall 171 toward the front panel 11. The first fastening member 175 is fixed to the front panel 11. The second fastening member 176 is fixed to the cover part 173 for engaging detachably the first fastening member 175. When the first and second fastening members 175, 176 are interengaged, the cover part 173 covers the opening 1741 so as to prevent the item in the receiving space 174 from falling out of the same.

A set of front wheels 21 and a set of rear wheels 22 are attached respectively to the front and rear ends of the bottom side 16 of the case body 10. The bottommost ends of the front and rear wheels 21, 22 are substantially coplanar on a plane 100.

The top side 15 of the case body 10 is substantially parallel to the plane 100.

The front end of the bottom side 16 has a first height (H1) with respect to the plane 100. The rear end of the bottom side 16 has a second height (H2) with respect to the plane 100. The first height (H1) is higher than the second height (H2). Therefore, the bottom side 16 is oblique to the plane 100, and forms an inclining angle $\alpha$ with respect to the plane 100.

The front, rear, left and right panels 11, 12, 13, 14 are substantially perpendicular to the plane 100. Each of the left and right panels 13, 14 has a trapezoidal shape. Since the rear end of the bottom side 16 is lower than the front end thereof, the center of gravity of the case body 10 is shifted rearwardly.

The handle 30 is retractably attached to the case body 10 in a conventional manner.

When the front and rear wheels 21, 22 are in contact with the ground, the user can push or tow the wheeled baggage case 70 of the present invention along the ground by grasping the handle 30, and pushing or pulling on the same.

From the aforementioned description, the advantages of the wheeled baggage case 70 according to the present invention can be summarized as follows:

1. The front and rear panels 11, 12 are substantially perpendicular to the plane 100, so that the wheeled baggage case 70 does not occupy much space.

2. The front, rear, left and right panels 11, 12, 13, 14 are substantially perpendicular to the plane 100, so that the wheeled baggage case 70, in a still position, is not easily tipped over or rearwardly by an external force.

3. Since each of the left and right panels 13, 14 is trapezoidal in shape, and since the front ends of the left and right panels 13, 14 are shorter than the rear ends of the left and right panels 13, 14, the center of gravity of the case body 10 is shifted rearwardly, and is distal from the front wheels 21, so that the user can smoothly push or tow the wheeled baggage case 70 of the present invention on an uneven surface, even if the front wheels 21 are chocked.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An ergonomic wheeled baggage case comprising:

a case body including a top side, a bottom side, and front, rear, left and right panels interconnecting said top and bottom sides, said bottom side having front and rear ends connected respectively to said front and rear panels, said front and rear panels being spaced apart from each other at a first distance, said left and right panels being spaced apart from each other at a second distance which is longer than said first distance;

a set of front wheels and a set of rear wheels attached respectively to said front and rear ends of said bottom side, and having bottommost ends which are substantially coplanar on a plane; and a handle attached to said case body;

wherein when said bottom side is at an acute angle to said plane, said front, rear, left and right panels are substantially perpendicular to said plane, and said top side is substantially parallel to said plane, said front end of said bottom side having a height from said plane higher than that of said rear end of said bottom side;

wherein said front panel has a length less than the length of said rear panel.

2. An ergonomic wheeled baggage case comprising:

a case body including a top side, a bottom side, and front, rear, left and right panels interconnecting said top and bottom sides, said bottom side having front and rear ends connected respectively to said front and rear panels, said front and rear panels being spaced apart from each other at a first distance, said left and right panels being spaced apart from each other at a second distance which is longer than said first distance;

a set of front wheels and a set of rear wheels attached respectively to said front and rear ends of said bottom side, and having bottommost ends which are substantially coplanar on a plane; and a handle attached to said case body;

wherein said bottom side is at an acute angle to said plane, said front, rear, left and right panels being substantially perpendicular to said plane, said top side being substantially parallel to said plane, said front end of said bottom side having a height from said plane higher than that of said rear end of said bottom side;

wherein said case body further includes a receptacle attached to said bottom side, said receptacle including a bottom wall opposite to said bottom side and having a pair of first sides and a pair of second sides, two opposite pleated walls, each of which is connected between a respective one of said first sides and said bottom side, one of said second sides being connected directly to said bottom side, said bottom wall, said pleated walls and said bottom side defining an opening in the vicinity of the other one of said second sides, said receptacle further including a cover part having one end connected to said other one of said second sides for covering said opening; and wherein said ergonomic wheeled baggage case further comprises a first fastening member fixed to said front panel, and a second fastening member fixed to said cover part for engaging detachably said first fastening member.

* * * * *